US011287172B2

(12) United States Patent
Tippmann

(10) Patent No.: US 11,287,172 B2
(45) Date of Patent: Mar. 29, 2022

(54) FREEZER DEHUMIDIFICATION SYSTEM

(71) Applicant: Tippmann Engineering, LLC, Fort Wayne, IN (US)

(72) Inventor: Daniel J. Tippmann, Fort Wayne, IN (US)

(73) Assignee: Tippmann Companies LLC, Fort Wayne, IN (US)

( * ) Notice: Subject to any disclaimer, the term of this patent is extended or adjusted under 35 U.S.C. 154(b) by 217 days.

(21) Appl. No.: 16/260,832

(22) Filed: Jan. 29, 2019

(65) Prior Publication Data

US 2019/0234677 A1 Aug. 1, 2019

Related U.S. Application Data

(60) Provisional application No. 62/624,161, filed on Jan. 31, 2018, provisional application No. 62/623,103, filed on Jan. 29, 2018.

(51) Int. Cl.
*F25B 49/02* (2006.01)
*F25D 21/04* (2006.01)
(Continued)

(52) U.S. Cl.
CPC ..... *F25D 21/04* (2013.01); *F25B 49/022* (2013.01); *F25B 49/027* (2013.01);
(Continued)

(58) Field of Classification Search
CPC ..... F25D 21/04; F25D 49/022; F25D 17/005
See application file for complete search history.

(56) References Cited

U.S. PATENT DOCUMENTS 4,827,733 A 5/1989 Dinh
5,269,151 A 12/1993 Dinh
(Continued)

FOREIGN PATENT DOCUMENTS

EP 0760452 A2 5/1997
JP H05223440 A 8/1993
(Continued)

OTHER PUBLICATIONS

Choi, "Power saving dehumidifying operation method of air conditioner" 2003, Full Document (Year: 2011).*
(Continued)

*Primary Examiner* — Elizabeth J Martin
*Assistant Examiner* — Nael N Babaa
(74) *Attorney, Agent, or Firm* — Faegre Drinker Biddle & Reath LLP

(57) ABSTRACT

An augmented heat transfer system can be used to control the humidity of adjacent conditioned spaces by selectively absorbing latent heat energy from a relatively warm space, such as a loading dock, and discharging this energy in the form of sensible heat to an adjacent relatively cold space, such as a freezer served by the loading dock. This transfer of sensible heat energy into the cold space induces a vapor compression system to remove sufficient moisture from the cold space to avoid uncontrolled precipitation. At the same time, the process of removing moisture/latent heat from the warm space can also be used to reduce humidity in the warm space via condensation on a cold evaporator. Therefore, in operations where the warm space and the cold space are both nominally sealed from ambient air, such as an indoor loading dock serving a freezer, the augmented heat transfer system can eliminate uncontrolled precipitation in the freezer while also mitigating moisture ingress to the freezer from the dock space.

20 Claims, 5 Drawing Sheets

(51) Int. Cl.

| | |
|---|---|
| ***F25D 21/00*** | (2006.01) |
| ***F25D 21/12*** | (2006.01) |
| ***F25D 17/00*** | (2006.01) |
| ***F25D 17/04*** | (2006.01) |

(52) U.S. Cl.

CPC ..... *F25D 17/005* (2013.01); *F25D 17/042* (2013.01); *F25D 21/006* (2013.01); *F25D 21/12* (2013.01); *F25B 2600/111* (2013.01); *F25B 2600/112* (2013.01); *F25B 2700/02* (2013.01); *F25D 2317/04131* (2013.01)

(56) References Cited

U.S. PATENT DOCUMENTS

| | | | |
|---|---|---|---|
| 5,586,441 | A | 12/1996 | Wilson et al. |
| 5,669,222 | A | 9/1997 | Jaster et al. |
| 7,000,414 | B2 | 2/2006 | Lee et al. |
| 7,886,983 | B2 | 2/2011 | Criss et al. |
| 8,196,425 | B2 | 6/2012 | Popov |
| 9,784,490 | B2 | 10/2017 | Tippmann |
| 2008/0102744 | A1 | 5/2008 | Moore et al. |
| 2010/0231100 | A1 | 9/2010 | Kato et al. |
| 2011/0225994 | A1 | 9/2011 | Fotiadis et al. |
| 2011/0232873 | A1 | 9/2011 | Seki |
| 2011/0302939 | A1 | 12/2011 | Rockenfeller et al. |
| 2014/0260383 | A1 | 9/2014 | Tippmann |
| 2015/0013354 | A1 | 1/2015 | Ramirez et al. |
| 2015/0377540 | A1* | 12/2015 | Jo ..... F25D 21/04 62/81 |

FOREIGN PATENT DOCUMENTS

| | | | | |
|---|---|---|---|---|
| JP | H10329536 | A | 12/1998 | |
| JP | 2004233034 | A * | 8/2004 | ..... F25B 13/00 |
| KR | 20060015976 | A | 2/2006 | |

OTHER PUBLICATIONS

Heat Pipe Technology for Greater Efficiency; Colmac Coil Manufacturing Inc. 4 pages.

IceDry; A Guide to Conditioned Cold Stores, Munters—Your Perfect Climate. 8 pages.

Frost, On Air-Cooling Evaporators, By Douglas T. Reindl, Ph.D, P.E., & Todd B. Jekel, Ph.D, P.E., published in ASHRAE Journal, Feb. 2009. 7 pages.

* cited by examiner

FREEZER DEHUMIDIFICATION SYSTEM

CROSS REFERENCE TO RELATED APPLICATION

This application claims the benefit under Title 35, U.S.C. § 119(e) of U.S. Provisional Patent Application Ser. No. 62/623,103, filed Jan. 29, 2018 and U.S. Provisional Patent Application Ser. No. 62/624,161, filed Jan. 31, 2018, both entitled FREEZER DEHUMIDIFICATION SYSTEM, the entire disclosures of which are hereby expressly incorporated by reference herein.

BACKGROUND

1. Technical Field

The present disclosure relates generally to refrigerant-based heat exchange systems, and more particularly to a refrigerant-to-air heat exchanger and an air-to-refrigerant heat exchanger with humidity control.

2. Description of the Related Art

Freezer warehouses are known in which large pallets of items including meats, fruit, vegetables, prepared foods, and the like are frozen in blast rooms of a warehouse and then are moved to a storage part of the warehouse to be maintained at a controlled temperature until their removal.

Vapor compression type refrigeration systems are used for controlling temperature within conditioned spaces, and by their operation, can also impact humidity. In the residential context, such air conditioning systems may be used to cool the air of the living space to a temperature below the ambient temperature outside the residence. In industrial applications, refrigeration systems may be used to cool and condition the air within walk-in/drive-in coolers or freezers, such as for cooling and/or preservation of certain products as noted above.

Basic vapor compression refrigeration systems utilize a compressor, condenser, expansion valve and evaporator connected in serial fluid communication with one another forming an air conditioning or refrigeration circuit. A quantity of condensable refrigerant, such as R717 or R517 refrigerant commonly used in refrigeration systems, is circulated through the system at varying temperatures and pressures, and is allowed to absorb heat at one stage of the system (e.g., within the cooled, conditioned space), and to dissipate the absorbed heat at another system stage (e.g., to the ambient air outside the cooled conditioned space). In the basic vapor compression refrigeration system, the evaporator is located within the conditioned space. Warm fluid, typically in the form of a liquid, is fed to the expansion valve, where the liquid is allowed to expand into a cold mixed liquid-vapor state. This cold fluid is then fed to an evaporator within the conditioned space.

The evaporator acts as a heat exchanger to effect thermal transfer between the cold refrigerant and the relatively warmer air inside the conditioned space, so that heat transfer to the refrigerant from the conditioned space vaporizes the remaining liquid to create a superheated vapor, i.e., a vapor that is measurably above its phase change temperature. This superheated vapor is then fed to a compressor that is typically located outside the conditioned space. The compressor compresses the refrigerant from a low-pressure superheated vapor state to a high pressure superheated vapor state thereby increasing the temperature, enthalpy and pressure of the refrigerant.

This hot vapor-state refrigerant is then passed into the condenser, which is located outside the conditioned space and typically surrounded by ambient air. Because the compressor sufficiently raises the pressure of the refrigerant, the resulting condensing temperature of the vapor is measurably higher than the ambient conditions surrounding the condenser. This temperature differential enables the condenser to effect a transfer of heat from the refrigerant to the ambient air as the high pressure refrigerant is passed through the condenser's heat exchanger at a substantially constant pressure.

This heat transfer effects another phase change in the refrigerant, from a hot vapor state to a slightly subcooled liquid state. This high temperature, liquid-phase refrigerant flows from the condenser and to the expansion valve to begin the process again.

As cold vapor-phase refrigerant passes through the evaporator as discussed above, the removal of heat from the conditioned air passing through the evaporator heat exchanger may cause the air passing through the heat exchanger to be cooled to below its saturation temperature, sometimes also referred to as a "dew point." This cooling causes moisture to precipitate out of the conditioned air, typically causing liquid or frost to form on the fins of the heat exchanger. In liquid form the condensed moisture will drip down into a catch pan or conduit where the liquid water can be withdrawn from the conditioned space. In the frozen state, the moisture can remain on the evaporator surfaces until a defrost cycle (or manual defrost) is able to melt the frost and enable it to drain out of the pan.

In this way, vapor compression type refrigeration systems are able to remove a certain amount of humidity from the conditioned space. The amount of humidity removed from the conditioned space is a function of the volume of air moved through the evaporator(s), the temperature differential between the refrigerant and the air as the air passes through the evaporator(s) and the relative humidity of the air (which is a driver of the dew-point temperature of the air). A greater temperature differential increases the amount of moisture that precipitates out of the conditioned air, thereby effecting greater dehumidification. Similarly, a greater volume of air moved through the evaporator and cooled to a given temperature can also effect greater dehumidification.

In some cases, the amount of humidity removable by the vapor compression system may not be adequate to compensate for the amount of humidity being introduced into the cooled space. In these instances, condensation and precipitation may occur within the cooled space, causing wetness, frost or snow to accumulate on surfaces and/or product within the cooled space.

Previously, desiccant systems have been used for humidity control in freezer spaces. These systems, such as the Munter Ice Dry system described in a reference described in a document submitted in an information disclosure statement on even date herewith, use desiccant which absorbs moisture from its surrounding environment. When the desiccant becomes saturated, it is heated to evaporate and remove the accumulated moisture. At this point, a new cycle begins in which the desiccant again absorbs moisture for later removal by heating. While this type of system may be effective at removing moisture from a cold-storage environment, its installation cost may be prohibitively expensive for some applications, and its energy-intensive operation also renders it costly to operate.

SUMMARY

The present disclosure provides an augmented heat transfer system which can be used to control the humidity of adjacent conditioned spaces by selectively absorbing latent heat energy from a relatively warm space, such as a loading dock, and discharging this energy in the form of sensible heat to an adjacent relatively cold space, such as a freezer served by the loading dock. This transfer of sensible heat energy into the cold space induces a vapor compression system to remove sufficient moisture from the cold space to avoid uncontrolled precipitation. At the same time, the process of removing moisture/latent heat from the warm space can also be used to reduce humidity in the warm space via condensation on a cold evaporator. Therefore, in operations where the warm space and the cold space are both nominally sealed from ambient air, such as an indoor loading dock serving a freezer, the augmented heat transfer system can eliminate uncontrolled precipitation in the freezer while also mitigating moisture ingress to the freezer from the dock space.

According to an embodiment of the present disclosure, a humidity control system is configured for use in a first space having a first temperature and a second space adjacent to the first space having a second temperature greater than the first temperature. The humidity control system includes a heat exchanger configured to be operably interposed between the first space and the second space and operable to absorb latent heat from the second space and discharge sensible heat into the first space, and a controller programmed to selectively operate the heat exchanger to discharge sufficient sensible heat into the first space to maintain a humidity in the first space at or below a threshold humidity, whereby the controller prevents or mitigates uncontrolled precipitation within the first space.

According to another embodiment of the present disclosure, the humidity control system includes: a conditioned space that is selectively sealed from outside ambient air, the conditioned space having a first temperature; a dock space adjacent to the conditioned space having a second temperature that is greater than the first temperature, wherein the dock space is selectively sealed from outside ambient air; a heat exchange system functionally interposed between the conditioned space and the dock space, the heat exchange system including: an evaporator in the dock space; a condenser in the conditioned space and operably coupled to the evaporator; a first fan operably coupled to the condenser, the first fan positioned to induce heat to flow from the condenser into the conditioned space; a second fan operably coupled to the evaporator, the second fan positioned to induce heat to flow into the evaporator from the dock space; and a controller operably coupled to the first fan, the controller programmed to control the rate of heat discharge from the condenser into the conditioned space by selectively activating the first fan, the controller programmed to control the rate of heat absorption from the dock space into the evaporator by selectively activating the second fan.

According to yet another embodiment of the present disclosure, the humidity control system includes: a conditioned space that is selectively sealed from outside ambient air, the conditioned space having a first temperature; a dock space adjacent to the conditioned space having a second temperature that is greater than the first temperature, wherein the dock space is selectively sealed from outside ambient air; a heat exchange system functionally interposed between the conditioned space and the dock space, the heat exchange system including: a heat exchanger operably disposed between the dock space and the conditioned space; a first fan operably coupled to the heat exchanger, the first fan positioned to induce airflow from the dock space through the heat exchanger and back into the dock space; a second fan positioned at an interface of the conditioned space and the dock space, the second fan positioned to induce airflow from the conditioned space through the heat exchanger and back into the conditioned space; and a controller operably coupled to the first fan, the controller programmed to control the rate of heat discharge from the heat exchanger into the conditioned space by selectively activating the first fan, the controller programmed to control the rate of heat absorption from the dock space into the heat exchanger by selectively activating the second fan.

BRIEF DESCRIPTION OF THE DRAWINGS

The above mentioned and other features and objects of this disclosure, and the manner of attaining them, will become more apparent and the disclosure itself will be better understood by reference to the following description of embodiments of the disclosure taken in conjunction with the accompanying drawings, wherein.

Figure 1:
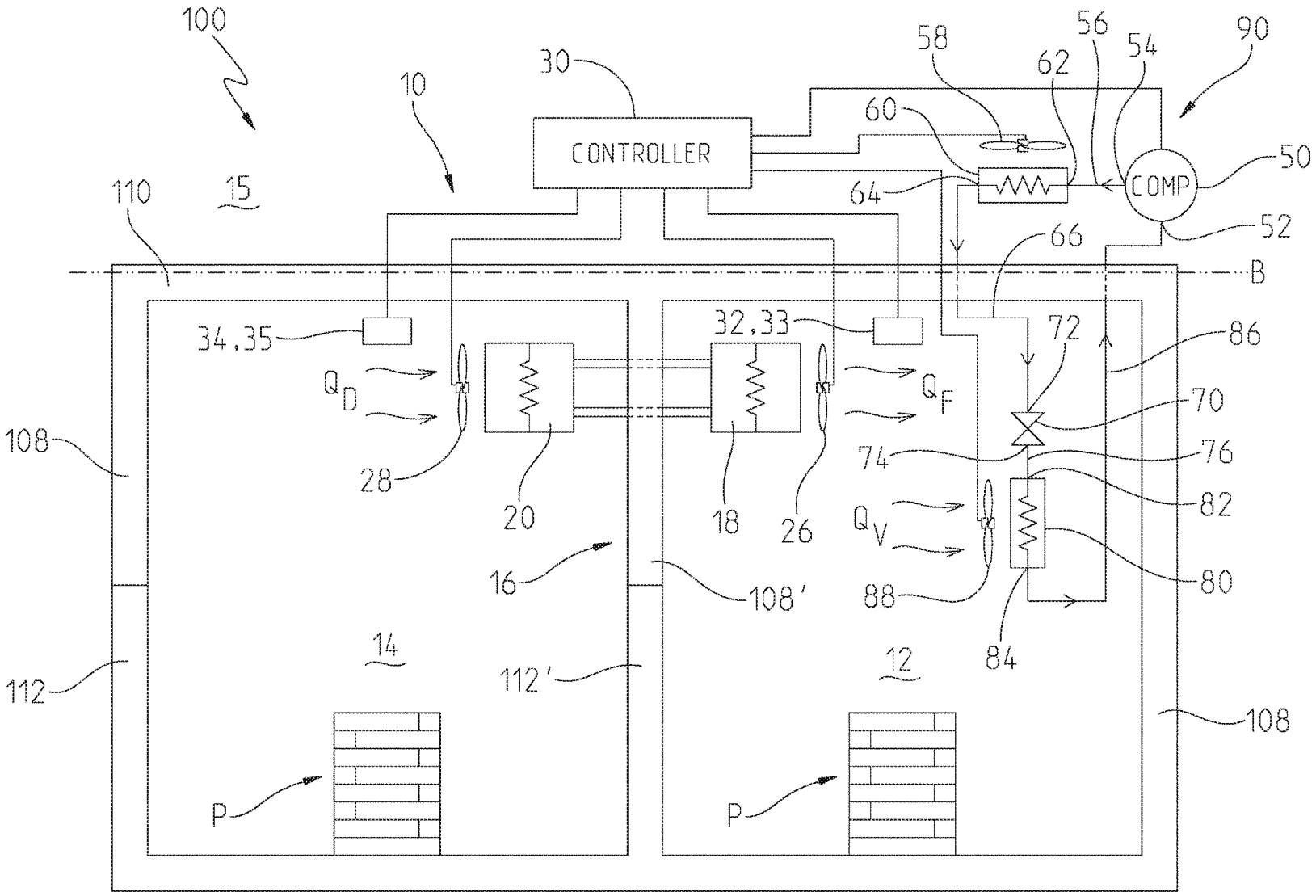
FIG. 1 is a schematic illustration of a warehouse having a heat exchange system in accordance with the present disclosure, together with a vapor compression system and a controller in accordance with the present disclosure.

Corresponding reference characters indicate corresponding parts throughout the several views. Although the exemplifications set out herein illustrate embodiments of the disclosure, in several forms, the embodiments disclosed below are not intended to be exhaustive or to be construed as limiting the scope of the disclosure to the precise forms disclosed.

DETAILED DESCRIPTION OF THE DRAWINGS

The present disclosure provides a heat exchange system 10, shown schematically in FIG. 1, which is functionally interposed between a staging space, illustratively dock space 14, and a conditioned space 12 such that heat exchange system 10 straddles and is positioned across interface 16. As shown in FIGS. 1-5, dock space 14 and conditioned space 12 are individual rooms that can be sealingly separated from each other by a selective barrier, e.g., a wall 108 with a door 112', at a thermally insulated interface 16. The temperature within dock space 14, which may be uncontrolled or controlled, is greater than the temperature maintained within conditioned space 12, which is a cooled and controlled environment serviced by vapor compression system 90. Because of the temperature difference and the operation of system 90, the absolute humidity (i.e., the amount of moisture carried by a given volume of air) within dock space 14 is generally greater than conditioned space 12. Heat exchange system 10 operates to selectively withdraw primarily latent heat $Q_D$ from dock space 14 and discharge sensible heat $Q_F$ into conditioned space 12. This transfer of energy is used to control relative humidity within conditioned space 12 below a precipitation threshold by selectively recruiting vapor compression system 90 to remove moisture, while also removing moisture from dock space 14 in order to reduce incoming humidity to conditioned space 12 when door 112' is opened.

1. Enclosed Freezer and Dock Space

Figure 2:
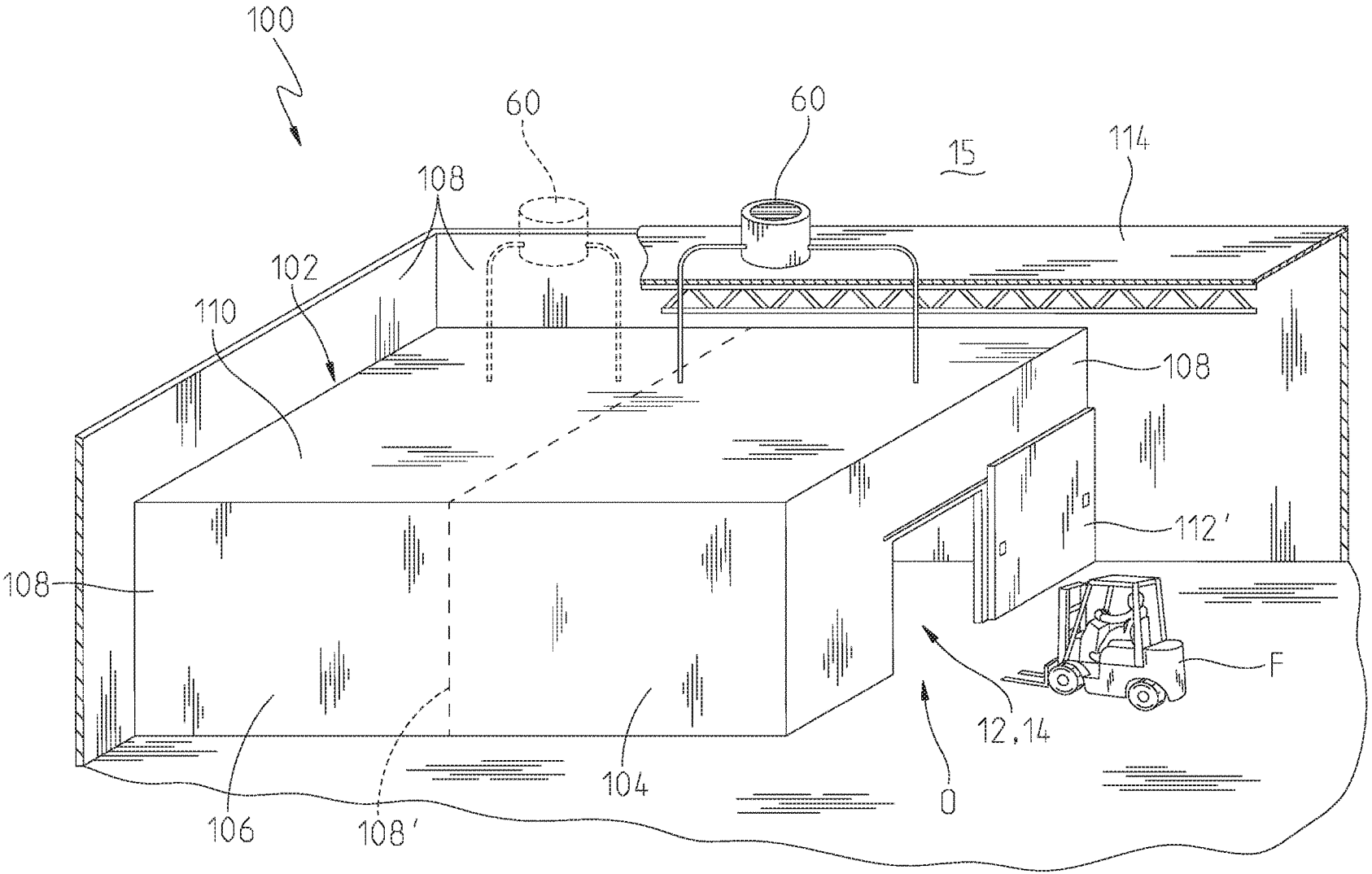
FIG. 2 is a perspective view of a portion of a warehouse, including a refrigeration housing utilizing a refrigeration system made in accordance with the present disclosure.

Referring to FIG. 2, an interior of warehouse 100 is shown to contain refrigeration housing 102, which may be one large cooled space or may be separated into a staging area/dock space 14 and a freezer space 12 by interior wall 108' as described below. In the exemplary embodiments described herein, refrigeration housing 102 has sufficient internal volume to serve as an industrial sized refrigeration and/or freezing unit. For example, refrigeration housing 102 may include a user access opening O of sufficient length and width for passage of people and equipment therethrough, such as forklift F used to move pallets P as shown in FIG. 1. For purposes of the present disclosure, such an industrial sized refrigeration housing 102 includes insulated walls 108 and insulated ceiling 110 cooperating to provide a ceiling height of at least five feet and/or an internal volume sufficient to house products and walkway space for workers and/or equipment. For example, refrigeration housing 102 may enclose a freezer space 12 defining a conditioned volume of at least 500 cubic feet, and in some embodiments as much as 10,000,000 cubic feet or more.

In the illustrated embodiment of FIG. 2, exterior walls of warehouse 100 form two of walls 108 which define the lateral boundaries of conditioned space 12. One of walls 108 includes opening O formed therein, with door 112' selectively positionable over opening O to enclose conditioned space 12. Insulated ceiling 110 is also contained within the enclosed volume of warehouse 100, with a separate exterior roof 114 spaced above insulated ceiling 110. In some alternative arrangements, warehouse 100 may have an insulated exterior roof 114 which also forms the insulated ceiling 110. Condenser 60, which forms a part of vapor compression system 90 as further described below, can be disposed on exterior roof 114 in ambient air 15 outside warehouse 100 to avoid exhausting heat into an inside space.

However, it is contemplated that other spatial arrangements for walls 108, ceiling 110, and roof 114 may be utilized as required or desired for a particular application, provided that conditioned space 12 is substantially thermally isolated from dock space 14, and that dock space 14 is substantially sealed from fluid exchange with ambient air 15.

In the context of the present disclosure, "substantially thermally isolated" means a space which is insulated and substantially sealed within reasonable practicable limits. For example, the substantial thermal isolation of conditioned space may mean that a temperature within conditioned space 12 can be maintained at a substantial differential (e.g., in excess of 50 degrees Fahrenheit) by activation of vapor compression system 90. A substantially thermally isolated space may be selectively thermally exposed by, e.g., a door which can be opened for ingress and egress but which remains generally shut during operation.

In the context of the present disclosure, "substantially sealed" means a space which experiences minimal fluid communication with surrounding ambient air within reasonable practicable limits. For example, dock space 14 may be a substantially sealed space such that the space experiences fewer than 2 air changes in a 24-hour period, e.g., the volume of air exchange with the ambient environment is less than or equal to twice the volume of dock space 14 over the course of one day. A substantially sealed space may experience selectively higher air exchange rates by, e.g., the opening of a door for ingress and egress which remains generally shut during operation.

2. Vapor Compression System

As shown in FIG. 1, vapor compression system 90 which operates to control the air temperature within conditioned space 12 and, by the nature of its operation, influences the relative and absolute humidity within conditioned space 12 as further described below.

System 90 utilizes a closed loop of fluid conduits joining the various system components and passing back and forth between conditioned space 12 and ambient air 15 across the insulated boundary B formed by ceiling 110 and/or walls 108. A quantity of refrigerant passes through the various fluid conduits 56, 66, 76, 86 and components 50, 60, 70, and 80 to absorb heat $Q_V$ from conditioned space 12 and discharge the absorbed heat into ambient air 15 as described in detail below, thereby cooling the air in conditioned space 12 relative to the temperature of the ambient air 15.

More particularly, compressor 50 receives cool or cold refrigerant in a vapor state at compressor inlet 52, and elevates the pressure of this vapor. According to the ideal gas law, pv=nrt, the elevation of the pressure of the warm vapor at a constant volume and in a constant amount causes an related increase in vapor temperature, thus, superheated pressurized vapor is discharged from compressor 50 at compressor outlet 54 and into fluid conduit 56.

This hot vapor is delivered to condenser 60 at condenser inlet 62, which passes the hot pressurized vapor through a tortuous path in the manner of a traditional heat exchanger. Air is passed over this tortuous fluid path to effect heat transfer from the hot, superheated refrigerant vapor to ambient air 15. This airflow over the heat exchanging elements of condenser 60 may be enhanced and controlled by condenser fan 58, which is positioned and oriented to force a flow of ambient air 15 over the heat exchanging elements of condenser 60. Thus, condenser 60 exhausts heat from the hot vapor received at condenser inlet 62 and converts such hot vapor into hot liquid, which is discharged at condenser outlet 64 and into fluid conduit 66. The structure and arrangement of condenser 60, in cooperation with control over condenser fan 58, ensures that the liquid passing through conduit 66 is measurably sub-cooled, i.e., is at a pressure and temperature combination that would require non-trivial changes to enthalpy of the refrigerant to convert the liquid back to a vapor.

Upon exit from condenser 60, liquid refrigerant is delivered to expansion valve 70 via fluid conduit 66 attached to expansion valve inlet 72. Expansion valve 70 operates to decrease the pressure of the hot or warm liquid refrigerant received therein, converting the liquid refrigerant to a cool or cold vapor/liquid mix, which is discharged at expansion valve outlet 74 into fluid conduit 76. This cool vapor/liquid mix is delivered to evaporator 80 via fluid conduit 76, which is fluidly coupled to evaporator inlet 82.

Like condenser 60 described above, evaporator 80 operates as a heat exchanger between the refrigerant passing therethrough and the surrounding air of conditioned space 12. However, in this case, the fluid passing through evaporator 80 is colder than the air within the conditioned space 12. Thus, as air passes over the tortuous fluid conduit of the heat exchanger within evaporator 80, heat $Q_V$ from conditioned space 12 is transferred to the refrigerant. This heat exchange process fully boils the liquid refrigerant inside the evaporator and further superheats the refrigerant, such that cool or cold vapor is discharged at evaporator outlet 84 and into fluid conduit 86. In an exemplary embodiment, evaporator fan 88 is selectively controllable to force air from conditioned space 12 over the tortuous fluid path of evaporator 80, thereby controlling the amount of heat transfer from conditioned space 12 to the cold refrigerant. The resulting warmed vapor-state refrigerant is then delivered via fluid conduit 86 to compressor inlet 52, and the cycle begins anew.

As the air passing over evaporator 80 is cooled by removal of sensible and latent heat $Q_V$, moisture may accumulate on the coils of evaporator 80. System 90 may be designed to evacuate such moisture in a liquid state and/or system 90 may include a defrost cycle known in the art for freezer vapor compression systems in order to liquefy any frozen accumulated moisture on evaporator 80, followed by evacuation of the liquid. In this way, evaporator 80 operates to dehumidify the air within conditioned space 12 during the process of removing sensible and latent heat $Q_V$. As further described herein, this dehumidification function of vapor compression system 90 can be leveraged by heat exchange system 10 to selectively control the relative humidity within conditioned space 12.

Referring still to FIG. 1, controller 30 is operably (e.g., electrically) connected to compressor 50, condenser fan 58, and evaporator fan 88. When controller 30 receives a signal from temperature sensor 33 within conditioned space 12 indicating that the temperature within conditioned space 12 is higher than a preprogrammed threshold or set point, controller 30 is programmed to send a signal to activate or increase the speed of evaporator fan 88, thereby increasing the air flow over evaporator 80 and increasing the transfer of sensible and latent heat $Q_V$ from conditioned space 12 to the vapor passing from evaporator inlet 82 to evaporator outlet 84. In addition, or alternatively, controller 30 may be programmed to send a signal to activate or increase the speed of condenser fan 58, thereby increasing the air flow over condenser 60, and removing additional heat from the hot refrigerant passing from condenser inlet 62 to condenser outlet 64. This additional heat removal causes the refrigerant delivered to evaporator 80 to be colder, which increases its capacity to receive sensible and latent heat $Q_V$ for a given speed of evaporator fan 88.

Moreover, controller 30 is also programmed to control the time and duration of activation of vapor compression system 90 by selectively activating compressor 50. When controller 30 activates compressor 50, refrigerant is circulated through system 90 to effect transfer of heat $Q_V$, while deactivation of compressor 50 avoids such heat transfer.

3. Latent and Sensible Heat Exchange and Humidity Reduction

As noted above, heat exchange system 10 is operable to control the relative humidity within conditioned space 12, while also efficiently dehumidifying dock space 14. In this way, heat exchange system 10 can be used in conjunction with controller 30 to avoid uncontrolled precipitation within conditioned space 12 by maintaining relative humidity below a threshold level, while also reducing introduction of new humidity from dock space 14 when door 112' is opened. These tandem benefits may be achieved with minimal additional energy consumption, as detailed below.

In addition to the temperature signal from temperature sensor 33, controller 30 receives a signal indicative of the ambient relative humidity within conditioned space 12 from a first humidity sensor 32. Humidity sensor 32 measures relative humidity at one location within conditioned space 12, thereby giving an indication of the overall relative humidity throughout conditioned space 12. In some applications (e.g., larger warehouse spaces), it is contemplated that multiple humidity sensors 32 may be used at different locations within conditioned space for enhanced accuracy.

When controller 30 receives a signal from humidity sensor 32 indicating that the relative humidity within conditioned space 12 is above a preprogrammed threshold, controller 30 activates heat exchange system 10 to add sensible heat $Q_F$ to conditioned space 12 while also removing latent heat $Q_D$ from dock space 14, as further discussed below. This addition of sensible heat $Q_F$ raises the temperature of conditioned space 12, inducing vapor compression system 90 to activate to lower the temperature. However, this increase in temperature within conditioned space 12 occurs without any concomitant introduction of humidity, and as vapor compression system 90 lowers the temperature, it simultaneously extracts humidity from the air within conditioned space 12. In this way, the addition of sensible heat $Q_F$ to conditioned space 12 can be used in concert with vapor compression system 90 to selectively lower the humidity within conditioned space 12, with a direct correlation between addition of sensible heat $Q_F$ and reduction of absolute (and, to the extent temperature remains constant, relative) humidity.

Heat exchange system 10 can also reduce the humidity of dock space 14, with the amount of humidity reduction selectively controllable via activation and/or speed control of fans 26, 28 by controller 30. In particular, as the operation of heat exchange system 10 removes primarily latent heat $Q_D$ from dock space 14, at least a local area around evaporator 20 is cooled within dock space 14. This cooling may reduce the localized temperature of the dock space air to below its dew point, such that liquid moisture precipitates and collects on the coils of evaporator 20. As this liquid is generated and collected, a concomitant reduction of humidity within dock space 14 occurs. Thus, heat exchange system 10 can be used to simultaneously reduce the existing humidity of conditioned space 12 and of dock space 14, such that incoming humidity to conditioned space 12 from dock space 14 is reduced when door 112' is opened for, e.g., ingress and egress of people, equipment and product (such as pallets P) to conditioned space 12.

Similar to humidity sensor 32 in conditioned space 12, humidity sensor 34 measures the relative humidity at a location within dock space 14, thereby giving an indication of the overall humidity throughout dock space 14. A signal is then issued from humidity sensor 34 to controller 30, which may use the signal to alter the operation of heat exchange system 10 as described below. In some instances, it is contemplated that multiple humidity sensors 34 may be used at different locations within dock space 14, similar to the use of multiple humidity sensors 32 as described above.

In an exemplary embodiment, controller 30 is programmed to avoid any uncontrolled precipitation within conditioned space 12 by maintaining the relative humidity of that space below saturation (i.e., 100% relative humidity) by a predetermined margin. Thus, controller 30 is programmed with a threshold relative humidity, above which controller 30 activates or increases the heat transfer via heat exchange system 10, with a corresponding activation of vapor compression system 90, in order to reduce the relative humidity below the threshold while maintaining a temperature set point within conditioned space 12. In one embodiment, for example, the threshold for relative humidity as measured by sensor 32 may be as low as 60%, 75% or 90%, and may be as high as 92%, 94% or 96%, or may be any humidity within any range defined by any pair of the foregoing nominal values.

When controller 30 receives a signal from humidity sensor 32 indicating that the relative humidity within conditioned space 12 and/or dock space 14 is above a pre-programmed threshold, controller 30 activates (or increases the speed of) fans 26 and/or 28 to draw air through condenser 18 and/or evaporator 20, thereby inducing or increasing the absorption of latent heat $Q_D$ from dock space 14 and corresponding discharge of sensible heat $Q_F$ into conditioned space 12. This addition of sensible heat $Q_F$ momentarily raises the temperature within conditioned space 12, thereby lowering the relative humidity and any further increases which might otherwise results in saturation and subsequent uncontrolled precipitation, e.g., in the form of frozen moisture (e.g., ice, "snow", frost, etc.). The rising temperature within conditioned space 12 may also exceed a maximum-temperature threshold programmed into controller 30, such that controller 30 activates or increases the function of vapor compression system 90, which removes moisture from conditioned space 12 and also lowers the relative humidity.

When humidity sensor 32 indicates that the relative humidity of conditioned space 12 has fallen to or below the pre-programmed set point, controller 30 reduces the output of fans 26, 28 or stops fans 26, 28 in order to reduce or cease the transfer of sensible heat $Q_F$. In an exemplary embodiment, controller may be programmed to reduce the relative humidity to a point below the threshold by a predetermined amount, such as between 1-5% below the threshold. This allows heat exchange system 10 to remain completely deactivated for a period of time before reactivation, thereby avoiding excessive cycling of system 10. Alternatively, controller 30 can use a feedback loop and one or more variable-frequency drives (VFD) to modulate the speed of fan 26 and/or fan 28, such that the speed of fans increases or slows rate of discharge of sensible heat $Q_F$ in proportion to a widening or narrowing difference, respectively, between the actual relative humidity as measured by sensor 32 and the programmed threshold. Where VFDs are employed, controller 30 may be programmed to slow the rate of discharge of sensible heat $Q_F$ to zero as this temperature differential difference reaches zero, i.e., when the measured relative humidity equals the target or threshold relative humidity.

As noted herein, the absorption of latent heat $Q_D$ can simultaneously reduce the humidity in dock space 14. In some applications of heat exchange system 10, this humidity level may also be monitored and/or controlled by controller 30, which can be programmed to compare a measured relative humidity and temperature within dock space by sensors 34, 35 respectively against a threshold or threshold range. For example, controller 30 may compute the absolute humidity within dock space 14 from the measured temperature and relative humidity, such that controller 30 can estimate the amount of expected moisture ingress to conditioned space 12 from dock space 14 resulting from the opening of door 112' (FIG. 1). Where the absolute humidity in dock space 14 is above a threshold, heat exchange system 10 may operate to remove humidity from dock space 14, even if the relative humidity within conditioned space 12 is at or below its threshold.

In some cases, controller 30 may be programmed to withstand a precipitation-triggering event, such as the opening of doors 112 and/or 112' (FIG. 1), which is expected to introduce a substantial and sudden increase in humidity in the air of conditioned space 12. To account for such an event, controller may take one or more actions to remove the newly-admitted humidity, including activing fan 28, activating fan 26, activating one or more elements of vapor compression system 90 (e.g., compressor 50 with fan 58 and/or fan 88), and/or increasing the speed of any of the activated fans.

As discussed above, controller 30 can be programmed to operate dynamically and substantially autonomously based on the inputs received from any combination or permutation of humidity sensors 32, 34 and temperature sensors 33, 35. However, it is also contemplated that in alternate embodiments controller 30 can operate in accordance with a predetermined schedule such that controller 30 periodically sends signals to humidity sensors 32, 34 to determine the relative humidity within conditioned space 12 and dock space 14. Based on these periodic readings, controller 30 activates or de-activates heat exchange system 10 and/or vapor compression system 90 to control the relative humidity of conditioned space 12 and/or dock space 14. Moreover, heat exchange system 10 may be capable of maintaining a desired level of relative humidity within conditioned space 12 despite changing environmental conditions, such as varying ambient humidity with changing seasonal weather (e.g., in the summer, more sensible heat may be discharged into conditioned space 12 by system 10 in order to address higher amounts of incoming humidity, while less sensible heat discharge may be sufficient for precipitation-free winter operation).

In addition to maintaining a setpoint humidity as described above, controller 30 may also monitor and utilize the temperature of conditioned space 12 and/or dock space 14, as measured by temperature sensors 33, 35. For example, controller 30 may be programmed with a setpoint and/or threshold range of temperatures for dock space 14. When the temperature as measured by sensor 35 is above the setpoint or threshold, controller 30 may activate heat exchange system 10 in order to remove latent heat $Q_D$ from dock space 14 and thereby lower the temperature to the desired temperature or temperature range. Conversely, when the temperature as measured by sensor 35 is below the setpoint or threshold, controller 30 may prevent activation of heat exchange system 10 to avoid any further lowering of the temperature.

The provision and operation of heat exchange system 10 in connection with a conditioned space 12 served by a vapor compression system 90, together with an adjacent dock space 14 which is also sealed from the ambient air, facilitates system performance and control which can be leveraged in the context of, e.g., industrial freezing and storage systems. As described in detail herein, humidity control within conditioned space 12 can be leveraged to avoid uncontrolled precipitation resulting from a high moisture load. For example, when a barrier located at interface 16 (e.g., door 112' in FIG. 1) is opened such that conditioned space 12 and dock space 14 are temporarily in fluid communication with each other, humid air from dock space 14 may enter conditioned space 12. Heat exchange system 10 may then operate to induce vapor compression system 90 to remove this newly-entered moisture, thereby preventing the air from reaching saturation and avoiding any formation of frozen moisture (e.g., "snow", ice, frost, etc.) on the functional surfaces (e.g., floor, shelving, product, etc.) within to conditioned space 12. This enhances warehouse safety, particularly in the presence of forklifts or other vehicles which benefit from dry floors. Other surfaces, including walls, doors, windows etc. are similarly kept dry in both the conditioned space 12 and the dock space 14, leading to enhanced sanitation and reduced degradation of materials and equipment (e.g., forklift electronics and other controls).

This avoidance of uncontrolled precipitation also protects evaporator 80 of vapor compression system 90 from becoming frequently "iced" or otherwise needing to be defrosted, which in turn preserves the proper and efficient function of evaporator 80 by ensuring proper air flow through the coil and preventing resistance to heat transfer between the air within conditioned space 12 and the refrigerant of vapor compression system 90. This leads to longer run times of vapor compression system 90 between defrost cycles, resulting in a substantial reduction in energy consumption and associated lower operating costs.

Moreover, heat exchange system 10 may be particularly useful in otherwise highly efficient freezer spaces, which may be super-insulated and/or use efficient, low-wattage lighting (as further described below). In such efficient conditioned spaces 12, vapor compression system 90 may operate too infrequently to remove significant amounts of moisture, leading to potential saturation of the air within conditioned space 12 in conditions that might not pose an issue in less-efficient freezer spaces. Heat exchange system 10 can ensure moisture removal in the right amount for any freezer space used in virtually any manner, including for such highly efficient freezer spaces.

For purposes of the present disclosure, heat exchange system 10 refers to any heat exchange system which is operable to selectively absorb latent heat $Q_D$ from dock space 14 and discharge sensible heat $Q_F$ into conditioned space 12. Exemplary heat exchange systems 10 are described in detail below as heat exchange systems 10A, 10B and 10C, with reference to FIGS. 3-5 respectively.

Figure 3:
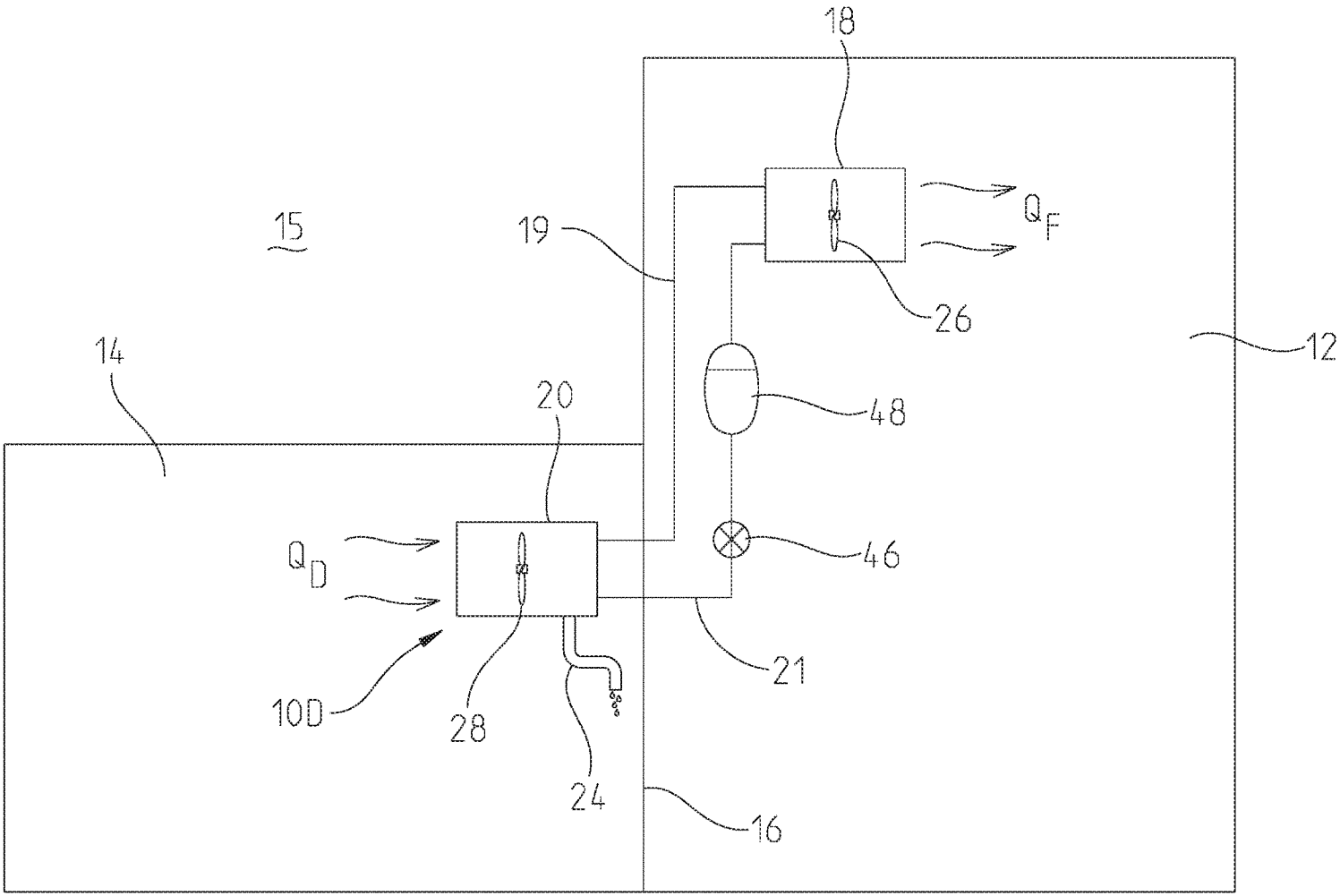
FIG. 3 is a side view of a heat exchange system in accordance with the present disclosure.
Figure 4:
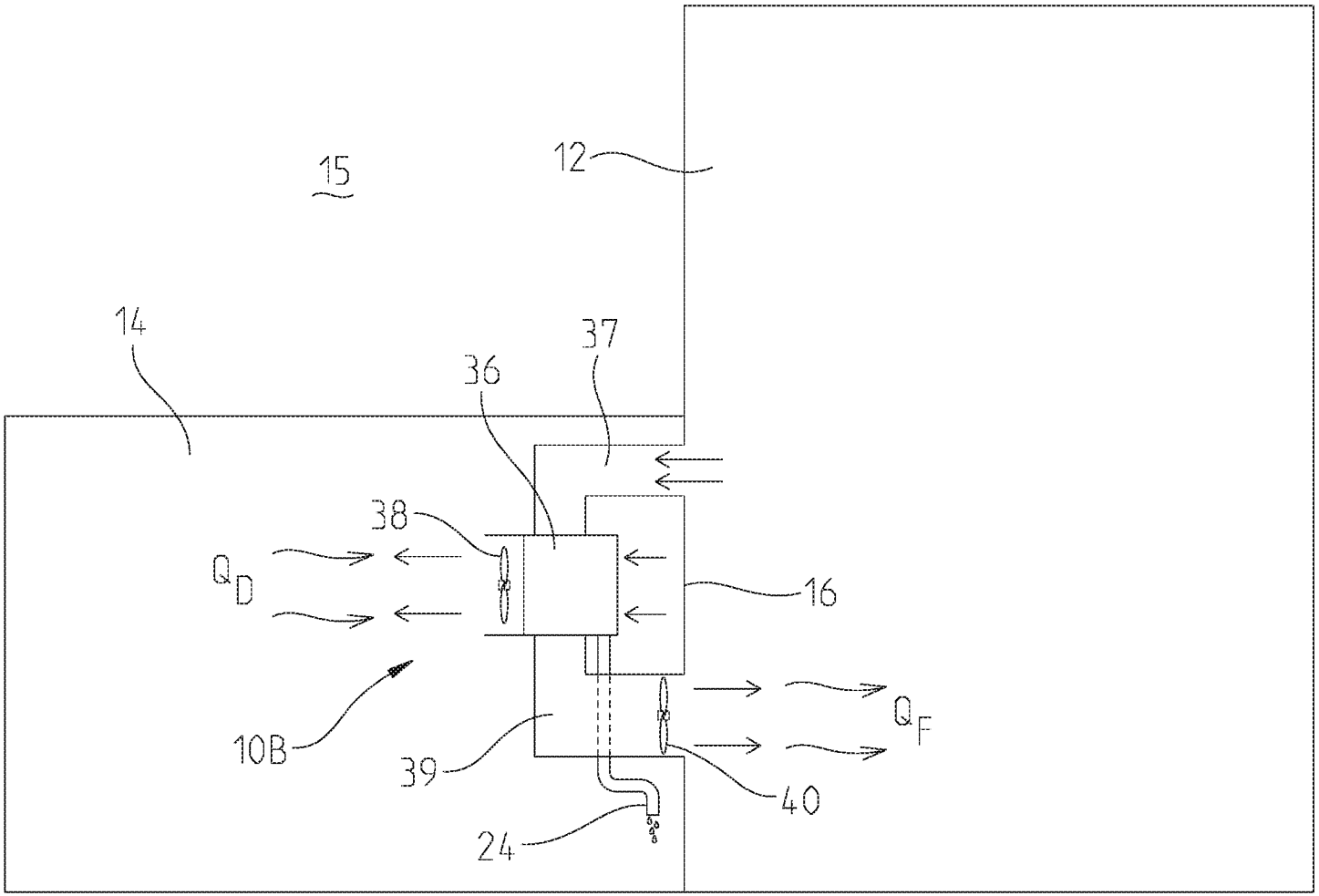
FIG. 4 is a side view of another heat exchange system in accordance with the present disclosure.
Figure 5:
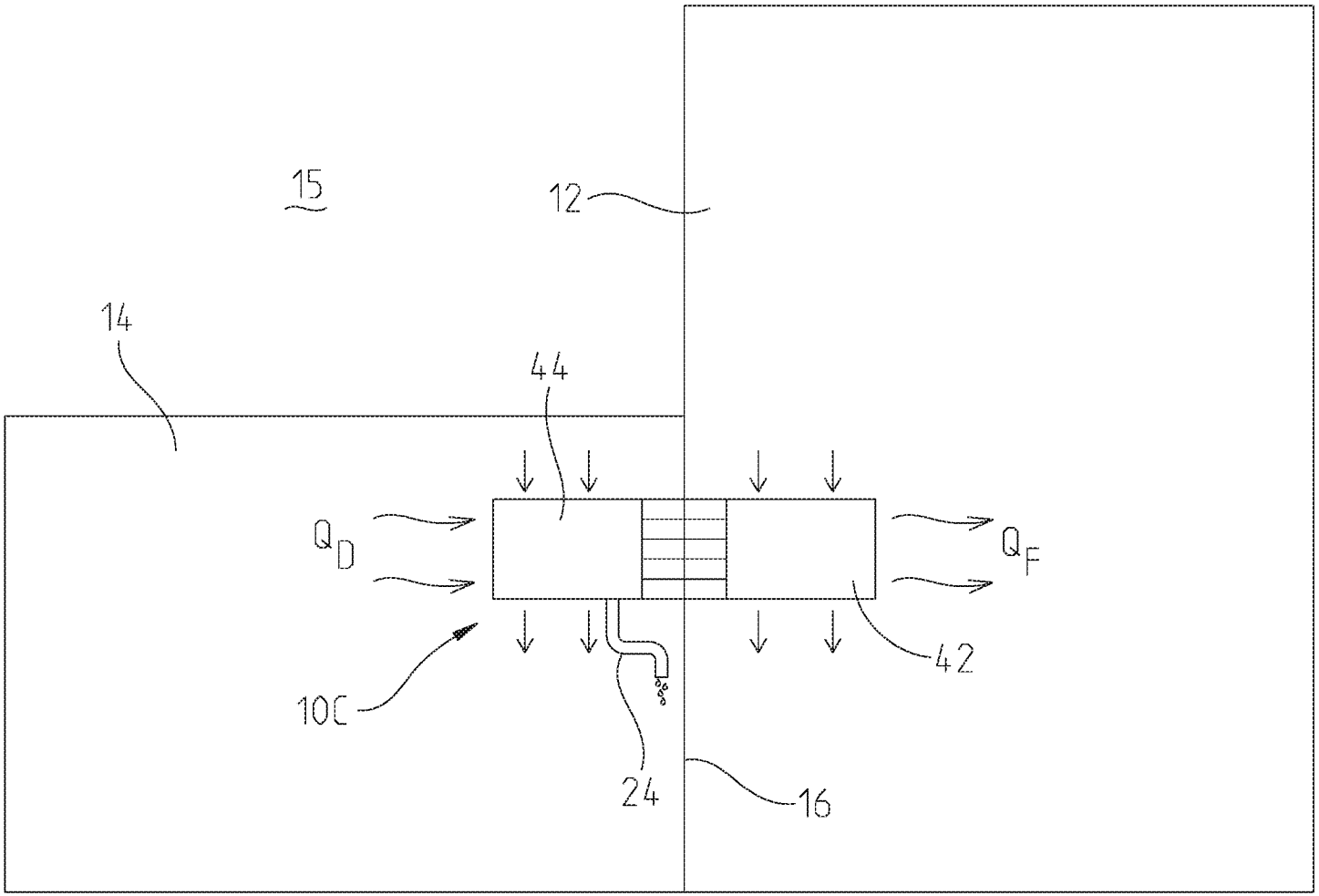
FIG. 5 is a side view of another heat exchange system in accordance with the present disclosure.

Each of heat exchange systems 10A, 10B and 10C, shown in FIGS. 3, 4 and 5 respectively, include a heat exchanger which can absorb latent heat $Q_D$ from dock space 14 and discharge sensible heat $Q_F$ into conditioned space 12. In all cases, this process may be controlled by controller 30 through operation of one or more fans which operate on the heat exchanger(s). In addition to the transfer of heat energy, systems 10A, 10B and 10C are also all operable to dehumidify dock space 14 by operation of the heat exchanger(s).

Turning now to FIG. 3, heat exchange system 10A is configured such that condenser 18 is elevated relative to evaporator 20, such that refrigerant may circulate through a closed loop solely under the force of gravity, or with the assistance of gravity. In particular, heat exchange system 10A utilizes a closed loop of fluid conduits 19, 21 joining the functional system components. A quantity of refrigerant passes through fluid conduits 19, 21 to withdraw primarily latent heat $Q_D$ from dock space 14, and to deposit an equal amount of sensible heat $Q_F$ into conditioned space 12. Sensible heat $Q_F$ is added to conditioned space 12 by allowing relatively warm vaporized refrigerant, after discharge from evaporator 20, to flow through fluid conduit 19 and into conditioned space 12. Vaporized refrigerant will then encounter condenser 18, which facilitates heat transfer between the relatively warm vaporized refrigerant and the relatively colder air in conditioned space 12, such that sensible heat $Q_F$ is discharged into conditioned space 12. In an exemplary embodiment, fan 26 blows cold air over the coils of condenser 18 to effect heat transfer as described above. The heat transfer from the refrigerant to the conditioned space 12 causes the refrigerant to condense to a liquid phase.

The liquid refrigerant is allowed to flow downwardly through fluid conduit 21 toward dock space 14, where it is received in evaporator 20. This liquid refrigerant was cooled by condenser 18 to a temperature below the temperature within dock space 14, such that the refrigerant absorbs primarily latent heat $Q_D$ from dock space 14 (e.g., via fan 28) as it passes through evaporator 20, which evaporates the refrigerant into a warm vaporized refrigerant that is allowed to drive upwardly through conduit 19 back to condenser 18. To the extent that the coils of evaporator 20 are cooled below the dew point of the air in dock space 14, moisture from dock space 14 collects on evaporator 20 and is allowed to flows downwardly through drain tube 24 under the force of gravity. This moisture may be collected and evacuated from dock space 14, thereby dehumidifying the air within dock space 14.

The positioning of condenser 18 higher than evaporator 20 in heat exchange system 10A allows the above-described heat exchange to operate without a compressor, because this configuration permits gravity-driven movement of refrigerant within fluid conduits 19, 21 of heat exchange system 10A. Moreover, to the extent that system 10A requires electrical power at all, such power is used only by fans 26 and/or 28, which can operate reliably over a long service life with minimal electrical draw. By not requiring any additional power components, heat exchange system 10A facilitates these heat exchange operations with low operating and maintenance costs.

In the illustrative embodiment of FIG. 3, fluid conduit 21 includes additional units along its path in order to facilitate and induce proper refrigerant flow between condenser 18 and evaporator 20. A powered flow-control valve 46 and refrigerant reservoir 48 are positioned along fluid conduit 21. Valve 46 and refrigerant reservoir 48 cooperate to allow evaporator 20 to be defrosted in the event of ice build-up. In particular, upon a determination that evaporator 20 requires defrosting (e.g., by user observation or a sensor sending a signal to a controller), valve 46 is toggled from an open configuration to a closed configuration. The liquid condensed in condenser 18 will then accumulate in reservoir 48 rather than flow down to evaporator 20. The interrupted liquid supply will prevent further cooling of evaporator 20, allowing the warm air around evaporator 20 to thaw any accumulated ice and thereby effect an air-defrost cycle. When it is determined that the air-defrost cycle is completed (e.g., by user observation or a sensor sending a signal to a controller), valve 46 is toggled back to an open configuration to continue heat exchange as described herein.

An alternative configuration of heat exchange system 10A shown in FIG. 3 may be provided with the same basic components, but with a different heat transfer medium and component arrangement. For example, a fluid such as a water/glycol mixture may be circulated between heat exchangers 18 and 20, but without the use of valve 46 or reservoir 48. In this system configuration, a pump may be used in place of valve 46 and reservoir 48 to circulate the fluid between conditioned space 12 and dock space 14. During such circulation, the fluid does not undergo a phase change. The fluid simply warms up as latent heat $Q_D$ is absorbed from dock space 14, and cools down as sensible heat $Q_F$ is discharged into conditioned space 12. This configuration of system 10A obviates the need to place heat exchanger 18 physically above heat exchanger 20, and benefits from a simplified set of components and low-pressure operation that combine for high economic efficiency.

Referring now to FIG. 4, heat exchange system 10B includes a single heat exchanger 36 that is located within dock space 14. Heat exchange system 10B further includes fluid conduits 37, 39 that are coupled to heat exchanger 36. Fluid conduit 37 directs air from conditioned space 12 into heat exchanger 36 while fluid conduit 39 directs air from heat exchanger 36 to conditioned space 12. Heat exchange system 10B further includes a fan 38 operably coupled to heat exchanger 36 and a fan 40 positioned within fluid conduit 39 at interface 16. Heat exchange system 10 further includes a drain tube 24 coupled to heat exchanger 36.

Heat exchange system 10B operates to control the humidity of both conditioned space 12 and dock space 14 similar to the heat exchange system 10A of FIG. 1. However, system 10B uses an air-to-air heat exchanger 36 rather than a closed-loop, fluid-based system as described above with respect to system 10A. In operation, fan 40 draws cold air from conditioned space 12 into intake conduit 37, which directs the cold air into heat exchanger 36. As the cold passes over the coils of heat exchanger 36, it mingles thermally (but not fluidly) with the warmer air of dock space 14, such that the cold incoming air withdraws heat $Q_D$ from dock space 14. In order to facilitate and/or enhance this air-to-air heat transfer, fan 38 directs ambient air from within dock space 14 into heat exchanger 36 and therefore into close thermal proximity with the cold air from conditioned space 12.

This air-to-air heat transfer results in warmer air exiting heat exchanger 36 into exhaust conduit 39, and back to conditioned space 12. In this way, sensible heat $Q_F$ is discharged into conditioned space 12, thereby providing similar benefits related to humidity reduction as described above with respect to heat exchange system 10 of FIG. 1. In an exemplary embodiment, fan 40 is provided in exhaust conduit 39 to "pull" air into heat exchanger 36 via intake conduit 37, and to blow the warmed air into conditioned space 12 via exhaust conduit 39. Fans 38 and 40 may be controlled by controller 30 in a similar or identical fashion to fans 28 and 26, respectively, as described in detail herein.

Similar to heat exchange system 10A of FIG. 3, heat exchange system 10B of FIG. 4 can also serve to control the humidity of dock space 14 while adding sensible heat $Q_F$ to conditioned space 12. In particular, the coils of heat exchanger 36 may be cooled below the dew point of the air in dock space 14 as the cold air from conditioned space 12 passes therethrough. Similar to other embodiment described herein, this localized cooling of dock space air causes condensation on the coils of heat exchanger 36, thereby removing moisture from the dock space air. This condensation flows through drain tube 24 and, in an exemplary embodiment, exits dock space via drain tube 24 into an external container.

Heat exchange system 10B also benefits from low power requirements and mechanical simplicity, since its only powered components are fans 38 and 40. In addition, it lacks any fluid conduit or closed-loop refrigerant system, further simplifying its setup and operational costs.

Referring now to FIG. 5, heat exchange system 10C may be implemented as a passive system or minimally-powered system. Heat exchange system 10C includes an evaporator side 44 having a drain tube 24, and a condenser side 42. Heat exchange system 10C straddles interface 16 with evaporator side 44 positioned within dock space 14 and condenser side 42 positioned within conditioned space 12. A plurality of coils are positioned intermediate evaporator side 44 and condenser side 42 of heat exchange system 10C. The coils are designed to efficiently transfer heat from a warm air stream to a colder one. In one exemplary embodiment, the coils are constructed of a hollow tube lined with a capillary structure. In an alternate embodiment, the coils used are heat pipe coils, such as those manufactured by and commercially available from ColMac Coil Manufacturing Inc. of Colville, Wash., USA.

When exposed to a temperature differential (e.g., the temperature differential between conditioned space 12 and dock space 14), volatile refrigerant contained within in the tubes cycle between evaporation and condensation, thereby effectively transferring heat between the condenser and evaporator sides 42, 44. In other words, latent or sensible heat $Q_D$ is removed from dock space 14 as it enters through evaporator side 44, and is transferred to the refrigerant contained within the coils. In an exemplary embodiment, convective and/or forced air flows across evaporator side 44 may facilitate this heat transfer, as illustrated. The refrigerant then moves from the evaporator side 44 to the condenser side 42 where sensible heat $Q_F$ is released into conditioned space 12, again by air flow over the condenser side 42 as shown. In this way, the temperature within conditioned space 12 increases without increasing the relative humidity. Additionally, the latent heat removed from dock space 14 effectively reduces the humidity within dock space 14 as described in detail with respect to systems 10A, 10B above.

In some applications of system 10C, it may still be desirable to include fan 26 operating on condenser side 42, in order to increase and/or control the amount of sensible heat $Q_F$ discharged into conditioned space 12. Similarly, fan 28 may be provided to operate on evaporator side 44, in order to increase and/or control the amount of latent heat $Q_D$ absorbed from dock space 14.

4. Retrofit Systems

It is contemplated that heat exchange system 10 may be integrated to new cooler/freezer system installations, or alternatively, may be added to pre-existing cooler/freezer systems as needed to address moisture issues. For example, in existing freezer systems which are retrofitted to increase efficiency, e.g., by adding insulation, tightening air sealing, or using more efficient lighting such as light-emitting diode (LED) based lighting, the new efficiency may change the moisture-removal characteristics of the existing vapor compression system (as noted above).

In such retrofitted systems, heat exchange system 10 may also be added to account for the changed moisture characteristics and control any uncontrolled precipitation which may otherwise occur in a newly-efficient freezer space. In effect, heat exchange system 10 can be used to "replace" sensible heat which might otherwise have been discharged by less-efficient lighting or insulation. However, heat exchange system 10 adds sensible heat $Q_F$ only to the extent necessary to avoid moisture precipitation, as described above, such that the efficiency gains may still be realized to the fullest extent possible given the moisture conditions present. Moreover, to the extent that the adjacent dock space 14 is sealed, heat exchange system 10 reduces the incoming moisture to conditioned space 12, such that the moisture conditions themselves are also at least partially controlled by the use of heat exchange system 10.

In one exemplary retrofit arrangement, heat exchangers 18 and 20 (FIG. 1) may be installed to a wall 108' or other partition between two existing spaces. For example, heat exchanger 20 can be installed in a preexisting dock space 14, while heat exchanger 18 can be installed in an adjacent preexisting conditioned space 12. Heat exchangers 18, 20 can then be functionally linked through the wall 108' or other partition as described herein. Temperature sensors 33, 35 and/or humidity sensors 32, 34 may be installed in the preexisting spaces along with fans 26, 28 as desired or required for a particular application. Controller 30 may then be functionally linked to the installed components, and optionally also to a preexisting vapor compression system 90. System 10, as thus retrofitted, may then be activated and calibrated to control the humidity and/or temperature in the preexisting spaces 12, 14.

While this disclosure has been described as having exemplary designs, the present invention can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A humidity control system configured for use in a first indoor space having a first temperature and a second indoor space adjacent to the first indoor space having a second temperature greater than the first temperature, the system comprising:

a heat exchanger configured to be operably interposed between the first indoor space and the second indoor space, the heat exchanger comprising:

a latent heat absorber positioned in the second indoor space and operable to absorb latent heat from the second indoor space; and a sensible heat discharger positioned in the first indoor space and operable to discharge sensible heat into the first indoor space; and a controller programmed to selectively operate the heat exchanger to discharge sufficient sensible heat into the first space to maintain a humidity in the first space at or below a threshold humidity, whereby the controller prevents or mitigates uncontrolled precipitation within the first space.

2. The humidity control system of claim 1, wherein the latent heat absorber comprises an evaporator.

3. The humidity control system of claim 1, further comprising a heat exchange system including:

the latent heat absorber formed as an evaporator in the second space;

the sensible heat discharger formed as a condenser in the first space, the condenser operably coupled to the evaporator;

a fan operably coupled to the condenser, the fan positioned to induce heat to flow from the condenser into the first space; and the controller programmed to selectively activate the fan, thereby controlling the rate of heat discharge from the condenser into the first space.

4. The humidity control system of claim 3, wherein the condenser is positioned above the evaporator such that movement of refrigerant through the heat exchange system is driven by gravity.

5. The humidity control system of claim 3, wherein:

the heat exchange system further includes a humidity sensor coupled to the controller and positioned within the first space, the controller is configured to receive an input indicative of the humidity within the first space from the humidity sensor and compare the input to the threshold humidity, and the controller is programmed to activate the fan when the input from the humidity sensor indicates the humidity within the first space that is greater than the threshold humidity.

6. The humidity control system of claim 5, wherein the controller activates the fan via a variable frequency drive operable to modulate a speed of the fan, the controller programmed to increase or slow the speed of the fan to modulate the rate of heat discharge in proportion to a difference between the humidity within the first space and the threshold humidity.

7. The humidity control system of claim 5, wherein:

the heat exchange system further comprises a second fan operably coupled to the evaporator and the controller, and the fan is configured and positioned to induce heat to flow into the evaporator from the second space.

8. The humidity control system of claim 7, wherein:

the heat exchange system further includes a second humidity sensor coupled to the controller and positioned within the second space, the controller configured to receive an input indicative of a humidity within the second space from the humidity sensor and compare the input to a second threshold humidity for the second space, and the controller is programmed to activate the second fan when the input from the humidity sensor indicates that the humidity within the second space is greater than the second threshold humidity.

9. The humidity control system of claim 1, wherein the first space further includes a vapor compression system comprising:

an evaporator separate from the latent heat absorber;

a condenser separate from the sensible heat discharger and operably coupled to the evaporator; and a quantity of refrigerant circulating between the evaporator and the condenser.

10. The humidity control system of claim 1, further comprising a building including the first space and the second space, wherein the first and second spaces are selectively sealed from outside ambient air and from one another.

11. A humidity control system comprising:

a conditioned space that is selectively sealed from outside ambient air, the conditioned space having a first temperature;

a dock space adjacent to the conditioned space having a second temperature that is greater than the first temperature, wherein the dock space is selectively sealed from outside ambient air;

a heat exchange system functionally interposed between the conditioned space and the dock space, the heat exchange system including:

an evaporator in the dock space;

a condenser in the conditioned space and operably coupled to the evaporator;

a first fan operably coupled to the condenser, the first fan positioned to induce heat to flow from the condenser into the conditioned space;

a second fan operably coupled to the evaporator, the second fan positioned to induce heat to flow into the evaporator from the dock space; and a controller operably coupled to the first fan, the controller programmed to control the rate of heat discharge from the condenser into the conditioned space by selectively activating the first fan, the controller programmed to control the rate of heat absorption from the dock space into the evaporator by selectively activating the second fan.

12. The humidity control system of claim 11, wherein the heat exchange system further includes a first humidity sensor coupled to the controller and positioned within the conditioned space, the controller configured to receive an input indicative of a humidity within the conditioned space from the first humidity sensor and compare the input to a first threshold, wherein the controller is programmed to activate the first fan when the input from the first humidity sensor indicates the humidity within the conditioned space that is greater than the first threshold humidity.

13. The humidity control system of claim 12, wherein the heat exchange system further includes a second humidity sensor coupled to the controller and positioned within the dock space, the controller configured to receive an input indicative of a humidity within the dock space from the second humidity sensor and compare the input to a second threshold humidity, wherein the controller is programmed to activate the second fan when the input from the second humidity sensor indicates the humidity within the dock space that is greater than the second threshold humidity.

14. The humidity control system of claim 13, wherein the conditioned space further includes a vapor compression system comprising:

a second evaporator;

a second condenser operably coupled to the evaporator; and a quantity of refrigerant circulating between the evaporator and the condenser.

15. The humidity control system of claim 11, wherein the condenser is positioned above the evaporator such that movement of refrigerant through the heat exchange system is driven by gravity.

16. A humidity control system comprising:

a conditioned space that is selectively sealed from outside ambient air, the conditioned space having a first temperature;

a dock space adjacent to the conditioned space having a second temperature that is greater than the first temperature, wherein the dock space is selectively sealed from outside ambient air;

a heat exchange system functionally interposed between the conditioned space and the dock space, the heat exchange system including:

a heat exchanger operably disposed between the dock space and the conditioned space;

a first fan operably coupled to the heat exchanger, the first fan positioned to induce airflow from the dock space through the heat exchanger and back into the dock space;

a second fan positioned at an interface of the conditioned space and the dock space, the second fan positioned to induce airflow from the conditioned space through the heat exchanger and back into the conditioned space; and a controller operably coupled to the first fan, the controller programmed to control the rate of heat discharge from the heat exchanger into the conditioned space by selectively activating the first fan, the controller programmed to control the rate of heat absorption from the dock space into the heat exchanger by selectively activating the second fan.

17. The humidity control system of claim 16, wherein the heat exchanger comprises an evaporator disposed in the dock space and a condenser operably coupled to the evaporator, the condenser disposed in the conditioned space.

18. The humidity control system of claim 16, wherein the conditioned space further includes a vapor compression system comprising:

an evaporator;

a condenser operably coupled to the evaporator; and a quantity of refrigerant circulating between the evaporator and the condenser.

19. The humidity control system of claim 16, wherein the heat exchange system further includes a first humidity sensor coupled to the controller and positioned within the conditioned space, the controller configured to receive an input indicative of a humidity within the conditioned space from the first humidity sensor and compare the input to a first threshold, wherein the controller is programmed to activate the second fan when the input from the first humidity sensor indicates the humidity within the conditioned space that is greater than the first threshold humidity.

20. The humidity control system of claim 19, wherein the heat exchange system further includes a second humidity sensor coupled to the controller and positioned within the dock space, the controller configured to receive an input indicative of a humidity within the dock space from the second humidity sensor and compare the input to a second threshold humidity, wherein the controller is programmed to activate the first fan when the input from the second humidity sensor indicates the humidity within the dock space that is greater than the second threshold humidity.

* * * * *